United States Patent [19]

Takano et al.

[11] 4,319,250

[45] Mar. 9, 1982

[54] OFFSET DUAL-REFLECTOR AERIAL HAVING TAPERED REFLECTOR SEGMENTS IN MAIN REFLECTOR

[75] Inventors: Tadashi Takano, Yokosuka; Motoo Mizusawa, Kamakura; Shinichi Betsudan, Amagasaki; Shigeru Sato, Amagasaki, all of Japan

[73] Assignees: Nippon Telegraph & Telephone Public Corp.; Mitsubishi Denki Kabushiki Kaisha, both of Tokyo, Japan

[21] Appl. No.: 919,954

[22] Filed: Jun. 28, 1978

[30] Foreign Application Priority Data

Jun. 29, 1977 [JP] Japan ..... 52-77477

[51] Int. Cl.[3] ..... G09F 9/00

[52] U.S. Cl. ..... 343/781 CA; 343/837

[58] Field of Search ..... 343/781 CA, 781 R, 781 P, 343/779, 837, 839, 840

[56] References Cited

U.S. PATENT DOCUMENTS 2,703,842 3/1955 Lewis ..... 343/840

3,821,746 6/1974 Mizusawa et al. ..... 343/840

OTHER PUBLICATIONS

Mizusawa, M. "Effect of Subreflector Radiation Pattern on a Cassegrain Antenna" Journal of the Electronic and Communication Society of Japan, 1969.

Y. Mizugutch "Offset Dual Reflector Antenna" AP-5 International Symposium, U. of Mass. Session 1, Oct. 11-15, 1976.

Cook, Elam and Zucker "The Open Cassegrain Antenna", BSTJ vol. 44, No. 7, Sep. 1965, pp. 1255-1300.

Galindo "Design of Dual Reflector Antennas with Arbitrary Phase and Amplitude Distributions" IEEE Trans. vol. AP-12, Jul. 1964.

*Primary Examiner*—David K. Moore

*Attorney, Agent, or Firm*—Oblon, Fisher, Spivak, McClelland & Maier

[57] ABSTRACT

A subreflector and reflectors in a primary radiation system, these constituting an offset dual-reflector aerial, are subjected to the so-called reflector-surface shaping. The main reflector is formed as a part of a revolutional paraboloid, and is a combination of a number of congruent reflector-segments. With such an arrangement, the manufacturing cost of a large-sized main reflector is reduced. The production error, and the aerial gain reduction and the deterioration of a wide-angle directivity due to the production error are minimized.

3 Claims, 8 Drawing Figures

(a)

(b)

(a) SIDE VIEW (b) FRONT VIEW

OFFSET DUAL-REFLECTOR AERIAL HAVING TAPERED REFLECTOR SEGMENTS IN MAIN REFLECTOR

BACKGROUND OF THE INVENTION

An offset dual-reflector aerial combined with at least one reflector is well known. It also is well known that, in the dual-reflector aerial such as Cassegrain aerials and Gregorian aerials, the so-called reflector surface shaping method is applied to the main reflector and the subreflector, these constituting an aerial, in order to improve electric characteristics such as gain, side lobe level, noise temperature, etc.

The original analysis on the off-set aerial has been described by J. S. Cook, E. M. Elam, and H. Zucker in an article "The Open Cassegrain Antenna Part I. Electromagnetic Design and Analysis" BSTJ, Vol. 44, No. 7, Sept. 1965, pages 1255 to 1300 and the reflector surface shaping method has been described by Victor Galindo, IEEE, "Design of Dual-Reflector Antennae with Arbitrary Phase and Amplitude Distributions" IEE Trans. on Ap. WL. Ap-12, No.-4, July 1964, pages 403 to 408. Other literature describing the same is an article "Effect of Subreflector Radiation Pattern on the Radiation Characteristic of a Cassegrain Antenna Subjected to Reflector-Surface Shaping" described by Motoo Mizusawa in Nihon Denshi Tsushin Gakkai-shi (Journal of the Electronic and Communication Society of Japan, 1969)

When such a method is applied to a large-diameter aerial, it is preferable, from an economical viewpoint, that the main reflector be constructed from a large number of congruent reflector-segments. FIG. 1 shows a segmentation of one of the conventional, rotational symmetrical type Cassegrain aerials reflector-surface shaped of rotational symmetrical type.

In FIG. 1, rings $P_1$ to $P_n$ are comprised of a number of congruent reflector-segments ($a_1$, $b_1$,-$m_1$) . . . ($a_n$, $b_n$,-$m_n$). The center cross-sectional figure of each ring $P_1$ to $P_n$ depends on only the radial segmentation and not on the peripheral segmentation. When such reflector segments are molded, n curved molds are necessary but the same curved mold may be used irrespective of the peripheral segmentation. This is advantageous in that the necessary kinds of the curved molds are reduced, thus leading to the reduction of the manufacturing cost and the stabilization of the production accuracy.

When an offset dual-reflector aerial as shown in FIG. 2 is constructed by using the reflector-segments, two segmentations as shown in FIGS. 3(*a*) and (*b*) are imaginable. In the case of the segmentation shown in FIG. 3(*a*), the reflector-segments are all different in shape so that this type segmentation is disadvantageous, from an economical viewpoint. In the case of the segmentation in FIG. 3(*b*), when the reflector system belongs to a revolutional secondary curved-surface system ($a_i$, $b_i$,-$n_i$), the center cross section of each reflector segment is identical and therefore this type segmentation is advantageous in the cost reduction of its manufacturing.

When the conventional reflector surface shaping method is applied to the main- and sub-reflector system, in order to improve the electric characteristic of the offset dual-reflector aerial of the revolutional secondary curved-surface system, the main reflector does not constitute a part of a secondary curved-surface of rotational symmetry.

Curves shown in FIG. 4 represent a typical cross-sectional figure of the main reflector whose surface is shaped. In the figure, the curve designated by 12 represents a cross section taken on the line X—X' in FIG. 3(*b*) and the curve by 13, a cross section taken along the line Y—Y'. When such a segmental reflector is molded by curved molds, for example, the respective segments are not congruent. Therefore, such a case needs curved molds equal in number to the reflector-segments, with the result that it is not economical, the production accuracy is poor and thus the electric characteristic is deteriorated.

SUMMARY OF THE INVENTION

Accordingly, an object of the invention is to provide an offset dual-reflector aerial with a large-sized main reflector which improves the production accuracy and the uniformity of products of the large-sized main reflector particularly.

Another object of the invention is to reduce errors in the manufactured reflector-surface of the main reflector and the like, thereby to eliminate the reduction of the aerial gain and the deterioration of the wide angle directivity due to the errors.

Still another object of the invention is to reduce the manufacturing cost of an offset dual-reflector.

DESCRIPTION OF THE PREFERRED EMBODIMENTS

The present invention which is directed to eliminate the abovementioned disadvantages, is so constructed that the main reflector is formed as a part of a revolutional secondary curved-surface thereby to permit it to be formed by a number of congruent reflector-segments, and the reflector-surface shaping method is applied to at least one main reflector and one subreflector in order to improve a necessary electric characteristic.

Figure 1:
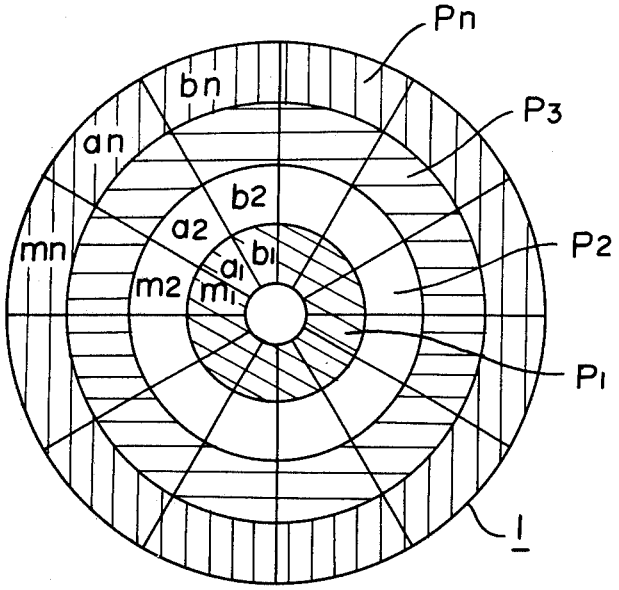
FIG. 1 illustrates a segmentation of the main reflector of a rotationally symmetrical Cassegrain aerial of which the surface is shaped.
Figure 2:
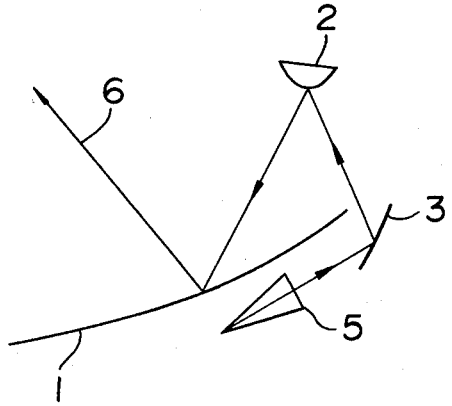
FIG. 2 schematically illustrates an offset Cassegrain aerial.
Figure 3:
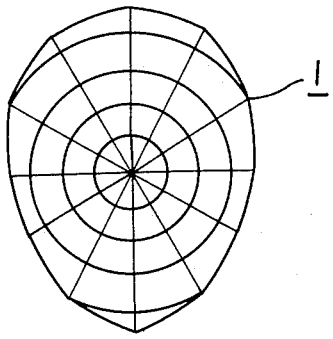
FIG. 3 illustrates segmentations of the main reflector of an offset dual-reflector aerial.
Figure 3:
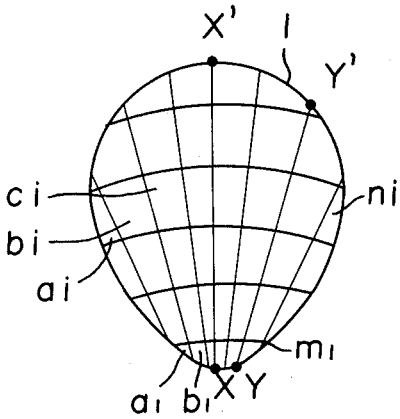
Figure 4:
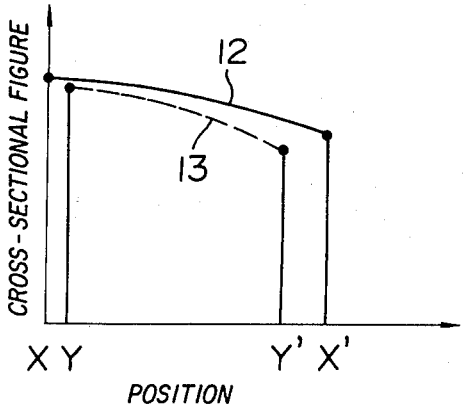
FIG. 4 illustrates a cross sectional view representing the cross sectional figures of the aerial shown in FIG. 3.
Figure 5:
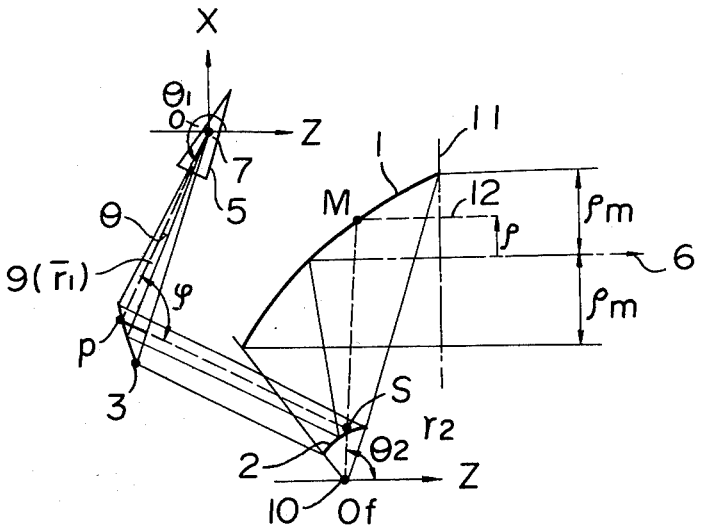
FIGS. 5 and 6 illustrate an embodiment of an offset dual-reflector aerial according to the invention.

An embodiment of the invention will be described by using an offset Cassegrain aerial shown in FIG. 5. In FIG. 5, reference numeral 1 designates the main reflector formed by a revolutional secondary curved-surface; numeral 2 a subreflector which is subjected to the reflector-surface shaping; numeral 3 a reflector (a focusing reflector) which is subjected to the reflector-surface shaping; numeral 5 a primary radiator for radiating radio waves toward the reflector 3 wherein the primary radiator is illustrated as a conical horn by way of example; and numeral 7 the phase center of the primary radiator.

A curve of the center cross section of each of the reflector 3 and the subreflector 2, is reflector-surface reformed in accordance with the following relation.

(i) Under a constant power $$\frac{\int_0^{\theta} w_p(\theta)\sin\theta d\theta}{\int_0^{\theta m} w_p(\theta)\sin\theta d\theta} = \frac{\int_0^{\phi} w_a(\phi)\phi d\phi}{\int_0^{\phi m} w_a(\phi)\phi d\phi} \quad (1)$$

where $w_p(\theta)$ is a pattern of the primary radiator, $w_a(\rho)$ is an aperture distribution, $\theta$ is an angle of light rays 9 of the primary radiator with respect to the center axis of the same, $\rho$ is the distance between a light ray 12 radiated from the main reflector and the center axis 6, and $\theta_m$ and $\rho_m$ represent the maxima of the angle $\theta$ and the distance $\rho$, respectively.

(ii) Under Snell's law

If $\overline{op}=\overline{r_1}$ in the reflector 3, we obtain $$\frac{d\overline{r_1}}{\overline{r_1}d\,\theta_1} = \tan\frac{\phi}{2} \quad (2)$$

If $\overline{o_f s}=\overline{r_2}$ in the subreflector 2, we obtain $$\frac{d\overline{r_2}}{\overline{r_2}d\,\theta_2} = -\tan\frac{\theta_1-\phi-\theta_2}{2} \quad (3)$$

(iii) Under a condition that the phase distribution is uniform on an aperture surface 11

$$\overline{r_1}+\overline{ps}-\overline{r_2}=\text{constant.}$$

It is assumed here that the main reflector 1 is a part of a revolutional secondary curved-surface with a focus 10, e.g. a revolutional paraboloid.

The light rays 9 radiated from the primary radiator 5 are reflected by the reflector 3 and the reflected light rays are shaped by the reflector 3 so as to have a given amplitude distribution (for example, a uniform distribution) at the position of the subreflector 2.

The subreflector 2 focuses the flux of incident light upon the focal point 10 of the main reflector and reflects it toward the main reflector 1, with the amplitude distribution at the subreflector 2. Accordingly, since the main reflector 1 is formed by a revolutional secondary curved-surface with a focal point at 10, the amplitude distribution on the aperture surface 11 is the reproduction of that at the subreflector 2. The phase distribution is uniform at the position 11 because the optical-path lengths of the respective light rays originated from the phase center 7 of the primary radiator are all equal. In this manner, through the reflector-surface shaping of a reflector and subreflector, a desired aperture distribution may be obtained at the aperture of the main reflector. Therefore, the efficiency of the aerial is improved and the side lobe level thereof is reduced. Additionally, the main reflector may be formed by several kinds of congruent reflector-segments so that the reflector of the invention is economical. Further, because of the manufacturing of a number of the congruent reflector-segments, the finished product is free from the variation of the production accuracy, with the minimization of the reduction of the aerial gain and the deterioration of the wide-angle radiation directivity due to the reflector surface error.

Figure 6:
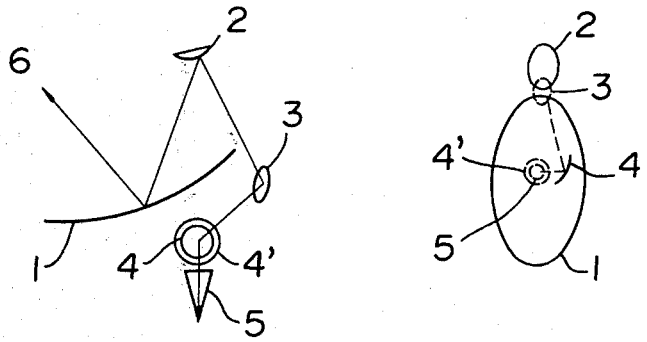
Figure 7:
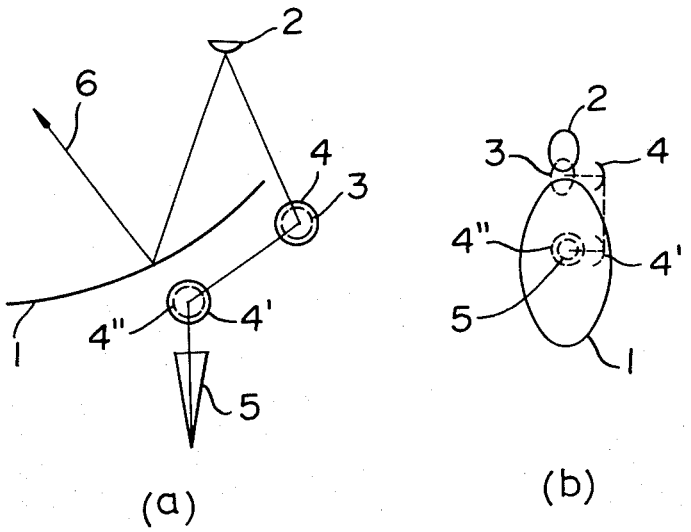
FIG. 7 shows another embodiment using a focusing beam feed system of four-reflectors type.

While the invention has been described relating to the offset Cassegrain aerial using a conical horn as the primary radiator, the invention is not limited to such but is applicable to reflectors as shown in FIGS. 6(*a*) and (*b*) and FIG. 7.

(i) An offset Cassegrain aerial using a three-reflector type focusing beam feed system. In this aerial, the reflector disposed closest to the subreflector is subjected to the reflector-surface shaping (FIGS. 6(*a*) and (*b*)).

(ii) An offset Cassegrain aerial using a four-reflection type focusing beam feed system. In the aerial, the reflector 3 closest to the subreflector is subjected to the reflector-surface shaping (FIGS. 7(*a*) and (*b*)).

Figure 8:
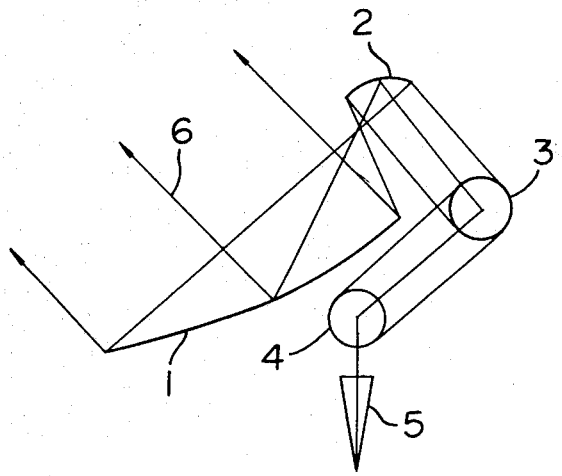
FIG. 8 shows still another object of the offset dual-reflector aerial according to the invention.

The invention also is applicable for an offset Cassegrain aerial in which the reflector-surface shaping is applied to at least two reflectors other than the main reflectors 1 in FIGS. 6 and 7. In the figures, numeral 4, 4′ and 4″ designate focusing reflectors. The invention is applicable for not only the offset Cassegrain aerial but the offset Gregorian aerial shown in FIG. 8.

As described above, in the present invention, the reflector-surface shaping method is applicable for the offset dual-reflection aerial. The main reflector may be formed as a part of a revolutional secondary curved-reflector (for example, a part of a revolutional paraboloid) thereby to permit it to be formed by a number of congruent reflector-segments. Therefore, the tools for manufacturing the reflector such as curved molds are advantageous from an economical viewpoint. Further, the manufacturing of a number of congruent reflector-segments remarkably stabilizes the variation of the production accuracy, and improves the electric characteristic resulting from minimization of the aerial gain reduction and the deterioration of the wide-angle radiation directivity due to the reflector surface error.

What is claimed is:

1. An offset dual-reflector aerial comprising:
a primary radiator radiating an electric field,
a main reflector formed by a part of a revolutionary secondary-curved surface and radiating an electric field radiated from said primary radiator to a space,
a plurality of reflector arranged between said primary radiator and said main reflector to reflect an electric field radiated from said primary radiator to said main reflector, in which said main reflector is formed by a plurality of tapered segmental reflectors and the surfaces of at least two reflectors arranged between said primary radiator and said main reflector are the shaped surfaces by which arbitrary amplitude and phase distributions of electric field can be realized at the aperture of said main reflector.

2. An offset dual-reflector aerial according to claim 1, in which said subreflector and said focusing reflector are arranged in a Cassegrain type with respect to said main reflector.

3. An offset dual-reflector aerial according to claim 1, in which said subreflector and said focusing reflector are arranged in a Gregorian type with respect to said main reflector.

* * * * *